United States Patent [19]

Richardson et al.

[11] 4,160,479

[45] Jul. 10, 1979

[54] HEAVY OIL RECOVERY PROCESS

[76] Inventors: Reginald D. Richardson, 53 Valecrest Dr.; Robert H. Shannon, 59 Valecrest Dr., both of Islington, Ontario, Canada, M9A 4P5

[21] Appl. No.: 899,758

[22] Filed: Apr. 24, 1978

[51] Int. Cl.[2] ..... C10G 1/02; E21B 43/24

[52] U.S. Cl. ..... 166/267; 166/65 R; 166/256; 166/272; 208/11 R

[58] Field of Search ..... 208/11 R, 213; 166/267, 166/265, 266, 303, 256, 65 R

[56] References Cited

U.S. PATENT DOCUMENTS

| | | | |
|---|---|---|---|
| 2,474,345 | 6/1949 | Clark et al. | 208/11 R |
| 3,118,746 | 1/1964 | Stratford | 208/11 R X |
| 3,687,629 | 8/1972 | Watkins | 208/213 X |
| 3,966,583 | 6/1976 | Cramer | 208/11 R X |
| 4,003,821 | 1/1977 | Weil et al. | 208/11 R |
| 4,007,786 | 2/1977 | Schlinger | 166/267 X |
| 4,060,479 | 11/1977 | Barcellos | 208/11 R |
| 4,069,132 | 1/1978 | Deering | 208/11 R |
| 4,087,349 | 5/1978 | Baird, Jr. | 208/213 X |
| 4,089,372 | 5/1978 | Terry | 166/267 X |

*Primary Examiner*—Stephen J. Novosad
*Attorney, Agent, or Firm*—Rogers, Bereskin & Parr

[57] ABSTRACT

A process incorporating integrated units and combined cycle energy production is provided for the recovery and upgrading of oil containing deposits which are not readily amenable to recovery and upgrading, to produce therefrom a light oil and elemental sulphur. Residual hydrocarbons generated in the process are gasified to produce hot gases which are used as a source of energy for process use, including electric power. The electric power is utilized to electrolyze water and produce hydrogen for use in upgrading and oxygen for use in gasification. The integration of gasification of residual hydrocarbons to produce, inter alia, electric power with the electrolysis of water to produce hydrogen for upgrading, and efficient use, distribution and recovery of energy in combined energy cycles provides an economical and essentially energy sufficient process with the flexibility to be adapted for the recovery and upgrading of various low yield oil deposits.

18 Claims, 4 Drawing Figures

HEAVY OIL RECOVERY PROCESS

This invention relates to a process for the recovery of oil and bitumen from heavy oil deposits, from tar sands, shale, or the liquifaction of coals and the upgrading thereof to produce light oil, medium oil or heavy oil, gases and elemental sulphur. The process is an integrated one in which the heavy oil is recovered from the ground and upgraded, with the low value hydrocarbon residual remaining after upgrading then being combusted or gasified to produce thermal energy for use both in ground recovery and upgrading and in producing other forms of energy required for optimum recovery and upgrading. The process is one having high thermal efficiency facilitating the efficient production, distribution and use of the energy required for both recovery and upgrading. The high degree of integration of the units of the process and the high thermal efficiency incorporated in this integration, results in a system which once initiated is essentially energy self-sufficient in that substantially all of the energy required for the recovery and upgrading stages can economically be provided from the hydrocarbons recovered.

A number of processes for the recovery of oil from heavy crude oil, tar sands, shale, or coal have been proposed and are in use. Present processes require importation to the site of costly fuels to supply process energy. The cost of producing such process energy is high not only because of the purchase cost of these fuels but also because of low thermal efficiency characteristic of its production from these imported fuels. For example, present heavy oil processes utilize hot water flooding and steam injection of the heavy oil deposit in order to reduce the viscosity of the heavy oil which can then be extracted in the form of a hot mixture of heavy oil and water. The thermal energy required to produce steam to heat the water prior to underground injection or to produce steam for direct underground injection is normally produced by burning externally supplied fuel. Propane or other combustible gases have been used. In some cases compressed air is injected underground where combustion takes place by ignition of the volatiles in the oil to provide an oil stimulation procedure known as fire flooding. The use of compressed air requires externally supplied electric power and costly compressor equipment.

Present processes for upgrading such hydrocarbons, such as heavy oil, utilize hydrogen for desulphurizing the oil. In the upgrading processes currently in use the hydrogen required is normally produced by reforming natural gas (methane) or naphtha and for this a hydrogen plant is required. In addition to the capital cost of a hydrogen plant, such reforming processes consume a valuable natural resource and the hydrogen produced contains a higher level of impurities than is desirable for optimum desulphurizing results. Approximately one-third of the source methane or naphtha is consumed in the reforming process. A further disadvantage of present upgrading processes is the production of coking residuals with high sulphur content which is stockpiled with objectionable environmental consequences and any energy value contained therein is thereby discarded. Also as with present recovery processes, the energy requirements for present upgrading processes are produced at high cost from imported fuels.

It has been found that these disadvantages and deficiencies of present recovery and upgrading processes can be overcome and other advantages created by providing a recovery and upgrading process which incorporates gasification of the low value residual hydrocarbons remaining after upgrading to produce thermal energy in the form of hot gases. This thermal energy can then be used directly for thermal stimulation in ground recovery and for the production of electric power and other forms of energy required in-process such as steam and hot water for recovery and upgrading. By producing this thermal energy from low value waste residuals of the hydrocarbons recovered, and then utilizing this energy in part to produce electric power and other forms of required energy by means of thermally efficient highly integrated combined cycles in which heat losses of the hot gases are minimized, the process energy requirements are satisfied at low cost. With low cost electric power available, electrolysis of natural water can be carried out economically, thereby producing at low cost the hydrogen required for desulphurization and the oxygen required for gasification. The need for costly hydrogen and oxygen production plants is thereby eliminated. At the same time, the electrolytic hydrogen produced is of the purity desirable to effect optimum desulphurization results.

Once in operation the process requires minimal supplies of fuel or energy from outside sources and only the supply of natural water in addition to the hydrocarbons recovered by the process system. By gasification of all of the hydrocarbon residuals, not only are their high energy values recovered for process use but the ecological problem created by stockpiling coking materials is eliminated.

The high thermal efficiency and the degree of integration of the various steps of the process, notably the unique integration of gasification of the hydrocarbon residuals and the decomposition of water by electrolysis together with overall efficient distribution and use of energy generated in the process, not only removes many of the difficulties of conventional systems, but provides major benefits.

It has been further found that the favorable economics of the basic process disclosed herein can be added to by the production of deuterium oxide, commonly referred to as heavy water, as a by-product. Therefore a second embodiment of the invention is designed to produce heavy water as a by-product of electrolysis. The principal factor providing the opportunity for the production of heavy water at low cost is again the unique combination of the gasification of hydrocarbon residuals to produce low cost energy including electric power and the electrolytic decomposition of water into hydrogen and oxygen. The water to be electrolyzed to produce hydrogen and oxygen is first partially enriched in deuterium and the extraction of the deuterium molecule from the hydrogen is then accomplished as a part of the electrolysis operation. Much of the cost of heavy water production is thereby incorporated in the cost of electrolytic production of high purity hydrogen and oxygen, the cost of the latter being a minimum due to the low cost in-process energy production.

Accordingly, a process is provided for the recovery of oil from low yield hydrocarbon sources and the upgrading thereof to produce a light oil, the process comprising the steps of recovering the hydrocarbon deposit from the ground; upgrading a feedstock concentrated with the hydrocarbon to produce therefrom a light oil, elemental sulphur and residual hydrocarbons; gasifying the residual hydrocarbons to produce hot gases; utilizing the hot gases to produce energy for use in the process including electric power; and, utilizing the electric power to electrolyze water to produce hydrogen for use in upgrading and oxygen to assist in the gasification of residual hydrocarbons.

These and other features of the present invention will be more readily apparent from the following description with reference to the accompanying drawings wherein.

Figure 1:
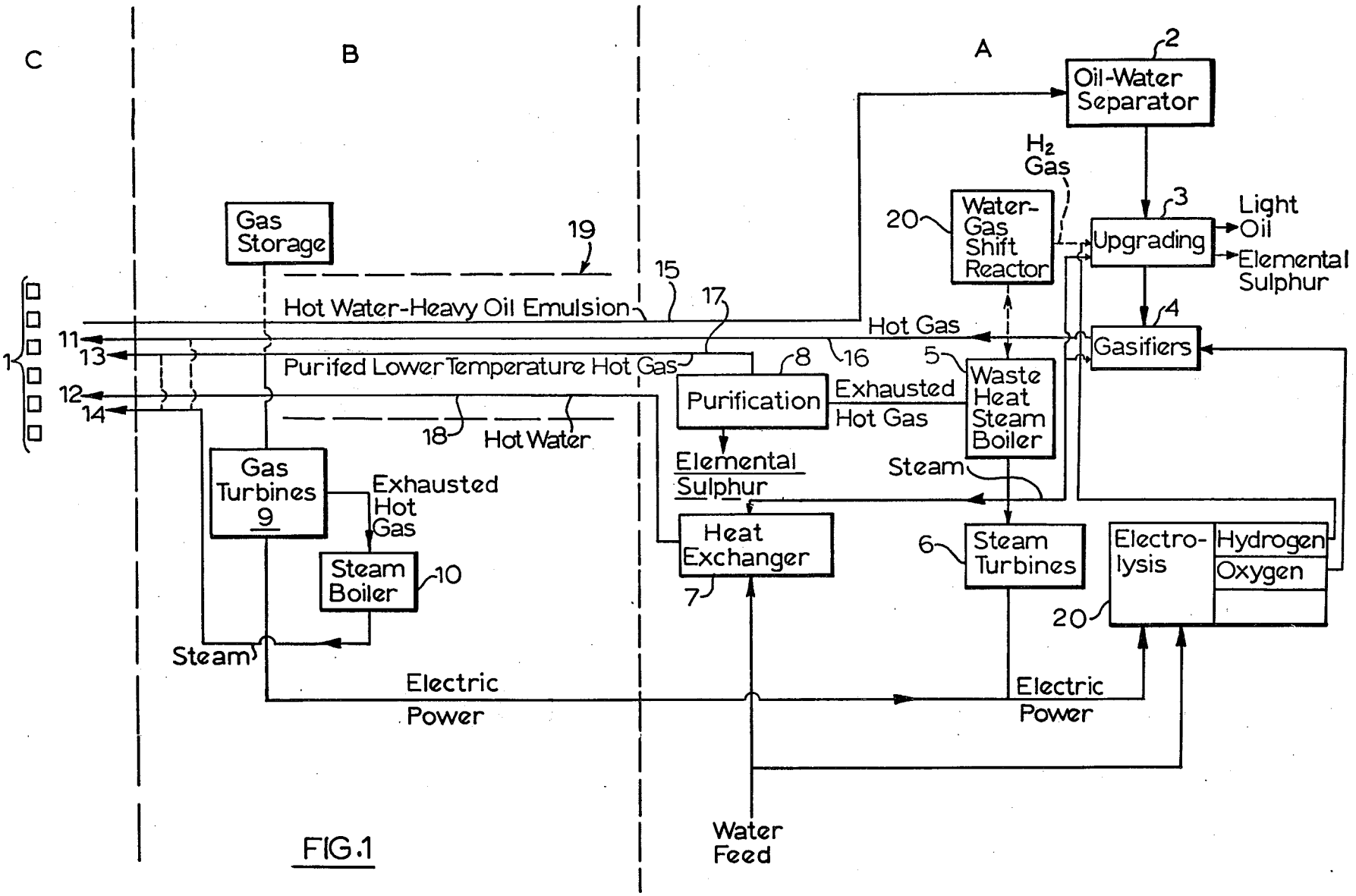
FIG. 1 is a simplified schematic flow diagram illustrating the processing steps of the present invention as applied to the recovery of oil from heavy oil deposits.

For the purpose of illustrating the invention, the invention as applied to the recovery of underground heavy oil deposits will be described.

RECOVERY

In accordance with the present invention there is provided a process for recovering heavy oil from ground deposits 1 by injection of thermal energy in the form of hot water (12), steam (14) and hot gases for stimulation (11) and underground burning (13). The hot gases are produced in-process from low value by-products of the heavy oil processing system and the steam and hot water are produced in process utilizing a portion of these hot gases as will be described below.

A heavy oil-hot water mixture is thereby created underground and this mixture is raised to the surface by pumping. Each heavy oil deposit varies in viscosity, in depth underground and in other factors which effect the amount and form of thermal energy required for stimulation. It is well established that the practice of stimulating heavy oil by means of thermal energy can result in a recovery of from 15% to 25% of a representative heavy oil deposit compared to 5% to 8% when thermal stimulation is not used. Thermal stimulation methods which utilize steam injections and underground burning are known in the art as steam injection and fire flooding respectively.

To reduce the viscosity of typical heavy oil deposits (non sand bearing types) sufficiently to achieve this increased recovery and raise one barrel of heavy oil requires 0.8 to 1.0 barrels of hot water at a temperature in the range of 80° C. to 100° C. This is supplied by the injection of a combination of hot water in the desired temperature range and steam preferably at a pressure between 300 psig and 500 psig and a temperature between 150° C. and 200° C. In the case of deep deposits of sand bearing heavy oils, which must be recovered by in-situ methods in which the sand content is not removed with the oil recovered, pressures of at least 2,000 psig and temperatures of at least 300° C. and larger volumes of water and steam may be required. The steam is necessary to achieve optimum liquifaction of the oil deposit in a minimum amount of time. The amount of steam required would not only vary between deposits but between extraction points within oil deposits and between points of time over the life of a given extraction point or oil well.

Hot gases produced in process gasifiers as described below, are in part burned underground to assist in raising the temperature of the oil deposit and to maintain at a high temperature the heavy oil-water mixture. The water content is made up of the hot water injected and that formed as steam condenses. It will be apparent that gasifier hot gas may be injected in combination with steam as part of a combined steam-hot gas injection method; or a portion of the gasifier hot gas may be injected alone into the heavy oil deposit area and ignited to effect thermal stimulation by fire flooding. The hot gas produced in process gasifiers is available at the point of injection into the oil deposit at pressures up to 150 atm. and temperatures between 800° C. and 1000° C. depending upon the parameters of gasifier operation. There will be some heat loss in transport from the gasifiers. As explained below, these losses are minimized by the use of an integrated, insulated duct system in which the hot heavy oil-water mixture is transported to the central plant A and the hot gases and hot water are transported to the deposit field C.

It is important and will be increasingly important in the case of large scale heavy oil recovery projects, to be able to supply thermal energy flexibly, that is in various forms such as hot water, steam and hot gas at various temperatures, pressures and volumes. It is important that thermal energy be provided in as complete a range of forms and conditions as practically possible to enable the flexible application of underground stimulation methods to particular deposits of heavy oil and that these various forms of energy be derived to the greatest extent possible from waste or low value residual hydrocarbons. As will become apparent in the description that follows, the process provides this flexibility.

UPGRADING

On extraction the heavy oil to water weight ratio at the surface will range from 1:08 to 1:1.1 in various degrees of emulsification. The heavy oil-water mixture is fed to a central processing plant A where it is first treated in an oil-water separator 2 to remove 99.0% to 99.5% of the water content.

After water removal the heavy crude oil is fed to process units 3 for upgrading by the separation of gaseous and light oil fractions from heavy residual oil fractions and desulphurization of the light oil fractions to produce a sweet light oil, the principal commercial product of the process. The heavy residual oil fraction is used as fuel in the gasifiers described below.

The selection of the most suitable oil-water separation, upgrading and desulphurization units is deemed to be within the scope of those skilled in the art. The selection will be influenced by the API, sulphur and mineral content of the crude oil feedstock. The selection will also be influenced by the availability of high purity hydrogen (99.5% pure) which is produced in the processing plant A by the electrolytic decomposition of water.

Following sections describe a gasifier combined cycle energy system and the process for the electrolytic production of hydrogen for heavy oil upgrading and desulphurization (and oxygen for gasifier operation). Gasifier combined cycle production of electric power and process heat and electrolytic production of hydrogen and oxygen are uniquely married or integrated, and this integration makes possible a number of the advantages of the overall process system. One of these advantages is the flexibility provided in the selection of upgrading processes.

The upgrading and desulphurization steps employ conventional practice, but with significant modifications to achieve optimum results when combined with the gasification and electrolytic operations incorporated in the process. Using steam produced by the combined cycle energy system, the heavy crude oil feedstock (3% to 4% or higher sulphur content) is distilled to separate a sulphur bearing light oil fraction from the feedstock. A high sulphur content residual oil remains. The sulphur bearing light oil product of the distillation process step is then desulphurized using high purity hydrogen (as high as 99.5%). The products of desulphurization are commercial grade light oil with a low sulphur content (0.3% or lower) and elemental sulphur.

The high sulphur content residual oil is divided into two portions, a first portion which forms the basic supply of in-process fuel feed to gasifiers which are capable of handling high sulphur content fuels. The second portion of residual oil is hydrocracked to produce second quantities of light oil fractions and a second quantity of residual oil. The light oil fraction produced by hydrocracking is then desulphurized together with the light oil fraction produced by distillation. The residual oil produced by hydrocracking is added to the above distillation produced residual oil and fed to the gasifiers.

It will be noted that the capability of gasifiers to handle sulphur bearing fuels eliminates the need to desulphurize the high sulphur content residual oil feed to the gasifiers. This minimizes the consumption of hydrogen for desulphurization. Part of the gasifier gas is later desulphurized by other less costly methods as described in a following section. In addition, the heat value of sulphur in combustion in gasifiers is available for recovery from the hot gases produced and the ecological problem of sulphur emissions experienced by present processes is eliminated. The quantity of hydrogen used in the upgrading process described above to hydrocrack the second portion of heavy oil and to desulphurize the light oil fractions produced by distillation and hydrocracking will be in the range of 5 to 7 pounds per barrel of light oil desulphurized and residual oil hydrocracked. Present practice is to desulphurize both light and heavy residual fractions with a resulting higher consumption of hydrogen and the creation of a coking residual problem, the coking residual being stockpiled or discarded.

GASIFICATION

The residual oil remaining after the distillation and hydrotreating steps are fed to a series of conventional gasifier units 4 to produce hot gases which are utilized in various ways to meet the energy requirements of the process. In a 100,000 barrels of light oil per day process plant a total of 8 to 10 gasifier units 4 would be employed, with an average capacity of 80 million cubic feed per day. These gasifier units 4 would produce sufficient hot gases for the production of 3 to 4 million pounds of steam per hour for process use in the central plant units A and field units B and 500 to 600 megawatts of combined electric power. It will be appreciated that fewer units of larger capacity can be used to produce the required energy.

A steam feed, extracted from the steam produced for process use, is used to raise the residual oil to a combustion point in the gasifiers. To enhance the BTU value of the gas produced, oxygen is fed to the gasifiers. The oxygen is produced by electrolysis, described below, and therefore the amount of the oxygen fed to the gasifiers will depend on the oxygen supply from the electrolysis system. As will become apparent in the description that follows, the oxygen supply from electrolysis will depend on the amount of water electrolyzed, which in turn depends on the amount of energy generated from the gasifier hot gases that is used to produce electricity versus the amount of that energy that is allocated for process use in central plants units A and for underground stimulation of oil deposits 1 in the deposit field C.

Preferably some gasifiers will be operated with 100% oxygen, some will operate with air-oxygen mixtures and others will operate with air only, with the whole gasifier system optimized for oxygen and air-oxygen mixture operation based on the energy required to satisfy process demands for electric power, hot gases for underground injection and on the process requirements for BTU value in hot gases and steam.

The temperature of the hot gases produced by the gasifiers will vary from 1,000° C. to 1,350° C. depending on the extent to which 100% oxygen is used in the gasifiers as opposed to air-oxygen mixtures and on the composition of the fuel feed. The more oxygen used, the hotter the gas will be and the higher its BTU value. The hot gases are used in two manners:

(i) for production of steam in waste heat steam boilers 5, and (ii) for direct underground injection 11.

The steam produced in waste heat boilers 5 is used to:

(i) drive steam turbines 6 for the production of electric power for electrolysis, (ii) for steam feed to heat exchanger 7 which is used to heat water for underground injection 12, and (iii) for steam feed to the gasifiers 4 and upgrading units 3.

The high temperature-high pressure gasifier gas that is directly injected underground (11) by-passes the waste heat boilers 5 and is piped directly to the deposit field C for use in thermally stimulating the deposits 1. This gas can either be injected alone or together with steam as described below. This hot gasifier gas used for underground injection (11) is not purified, thereby confining loss of heat to that lost in transport and making hot gas available for field injection at temperatures in the range of 800° C. and 1,000° C. and at pressures up to at least 150 atms. Such high temperatures and pressures are required for deep deposits of sand bearing heavy oils, the oil of which must be separated out by in-situ methods. The high temperature and pressure gases are particularly useful for initial heating of a deposit.

Hot gas, now partially cooled, is exhausted from the waste heat boilers 5. To facilitate use of this lower temperature hot gas that achieves sensible heat recovery therefrom, it is fed to a purification unit 8 to remove acid gas. This may be done in any one of a number of physical or chemical absorption processes. The selection of the most advantageous method is deemed to be within the scope of those skilled in the art. Elemental sulphur is produced as part of the gas purification step.

This lower temperature hot gas exists from gas purification unit 8 at a temperature of between 100° C. and 200° C. and is utilized in two manners.

(a) in the recovery system for direct underground injection 13 for fire flooding. The BTU value per SCF of the hot gas will be in the range of 200 BTU to 325 BTU, depending on the gasifier air-oxygen mix.

(b) as fuel to power gas turbines 9, which are located with field units B intermediate the central plant A and deposit field C. The gas turbines 9 are utilized for the production of additional electric power with the hot exhaust gases from the gas turbines 9 being used for the production of steam in a second set of steam boilers 10 located with field units B. This steam is used for direct ground injection 14.

The piping and process equipment for the ground injection of steam produced in the steam boilers 10 is designed to be portable and provide for a direct tie-in to both the supply of hot gasifier gas (11) and the supply of purified lower temperature hot gas (13). The purified hot gas can thereby be utilized for direct ground injection 13 to facilitate fire flooding or as underground heat supplement to steam for maintaining the deposit at operating temperature.

The availability of purified hot gases for use in fire flooding as described in (a), and hot gasifier gases for direct injection, either alone or in a mixture with steam, for temperature maintenance underground, is a most valuable feature of the process. The quantity of these gaseous forms of energy required, in addition to hot water or steam, will vary with the depth of the oil deposit, the structure of the deposit and other factors such as the viscosity of the oil. The process is flexible in that the division of hot gasifier gas for (i) steam production or, (ii) direct underground injection (11); and the subsequent division of purified hot gas for (a) underground injection (13) as gas or in a mixture with steam or, (b) for the production of electric power and steam by combined cycle gas turbines 9 in field units B, may be varied depending on the oil deposit. For example at process initiation, all the hot gasifier gases may be used for underground stimulation in order to bring the deposits up to operating temperatures. Thereafter, the utilization of gas in the various forms is used to achieve an optimum balance between maintaining oil deposit temperature and upgrading.

As described, the process provides for a centralized group of process units indicated generally as units A in the flow diagram and decentralized oil field units indicated generally as units B. Units A are connected with the deposit field C by oil pipeline 15 for the transport of heavy oil from the field to the central plant. Gas pipelines 16, 17 and 18 connect units A to units B and the deposit field C, and transport the gasifier hot gases, the purified hot gas from purification unit 8, and hot water respectively, for use in the field C and units B, as already described. All piping systems connecting the central processing units A to the field units B, and connecting both units A and B to individual extraction points for the deposits 1 in the deposit field C, are contained in an enclosed duct system, indicated generally at 19. The duct system 19 is insulated to minimize heat loss of the oil-water mixture transported to the central plant A, the gas transported to the field units B and the steam or gas being transported to individual extraction points. It is preferable that only gases and no steam are transported to the field units B and deposit field C from central units A as gas may be more efficiently transported over the distances involved than steam, i.e. less temperature and pressure loss, and it is desired to make gas available in the field. The gas is preferred in the field for two purposes: (1) for turbine combustion 9 and consequential steam production for ground injection 14, and (2 ) for direct underground injection at extraction points for fire flooding. The steam produced in steam boilers 10 from hot gases exhausted from turbines 9 in field units B can then be transported to the extraction points of the deposits 1 in deposit field C in injection 14 without significant heat loss. This steam transport may be done efficiently over the distances involved from units B to deposit field C which are shorter than the distances from central units A to units B. It will be noted that the use of gasifiers in the central plant A makes possible the benefits of high thermal efficiency combined cycle energy production and distribution in the various forms in an integrated and flexible manner.

Electrolysis is used for the production of hydrogen and oxygen. The electrolysis units 20 use electric power produced in process. For example, 500 to 600 megawatts of electric power will electrolyze 800,000 to 900,000 gallons of water per day to produce 700,000 to 900,000 pounds per day of hydrogen and 6 to 8 million pounds per day of oxygen. This range of oxygen production will permit four gasifiers of the capacity described above to operate with 100% oxygen. The use of electrolysis in the process invention to produce hydrogen and oxygen for process use is feasible because of the availability of low cost electric power produced in process. If electric power had to be purchased, the cost of doing so would dictate (i) a different means of producing hydrogen, such as a hydrogen plant to break down methane, and (ii) the purchase of the oxygen required for process use, or the addition of an oxygen plant. The efficient use of thermal energy produced from low value oil residuals to produce, inter alia, low cost electric power renders the use of electrolysis feasible and thereby produces at low cost both the hydrogen and oxygen required by the process.

Figure 2:
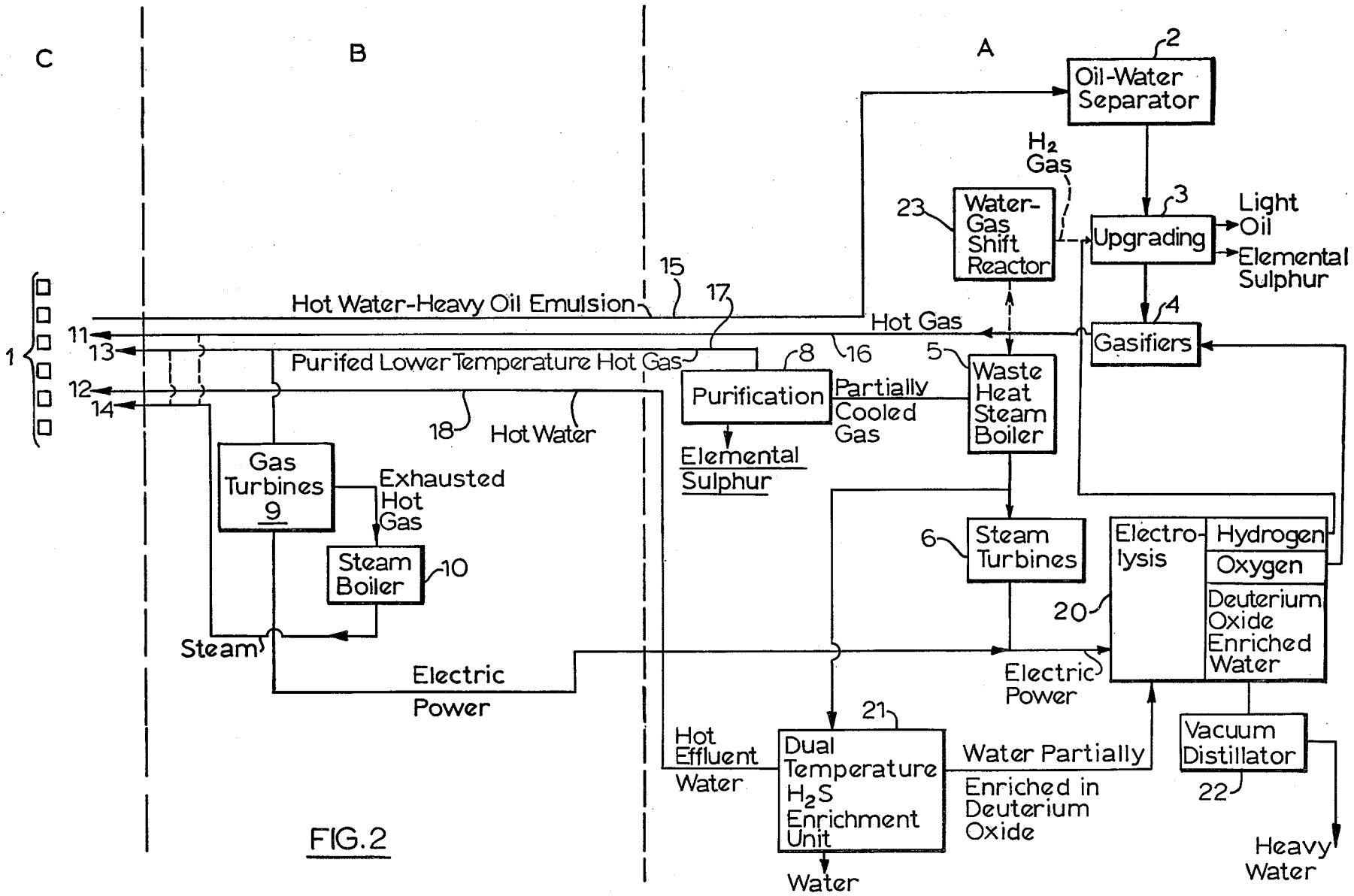
FIG. 2 is a simplified schematic flow diagram of a second embodiment of the present invention as applied to heavy oil deposits and further illustrating the production of heavy water as a process by-product.

Reference is now made to FIG. 2 which shows a second embodiment of the process. To further enhance the economic feasibility of the process a natural water feedstock to the electrolysis units 20 is partially enriched in deuterium oxide in an $H_2S$ enrichment unit 21. This partial deuterium oxide enrichment of the water in the $H_2S$ enrichment unit 21 is quite low, as low as 6 to 10 times the natural deuterium oxide content in water, i.e. 900 p.p.m. to 1,500 p.p.m. This initial enrichment would preferably be accomplished by dual temperature hydrogen sulphide exchange utilizing what is commonly referred to as the GS process. The design of a GS process plant to partially enrich the electrolysis water feed to the level indicated above permits significant capital and operating cost reductions over present GS plants because of the smaller and less complex equipment needed to achieve the low level of enrichment required in the initial step. This smaller and less complex equipment also reduces the hazard factor inherent in the use of $H_2S$ gas.

After electrolyzing the partially enriched water in the electrolysis units 20 to produce hydrogen and oxygen, the water that remains is deuterium enriched to a level of 5% to 10% deuterium oxide. This water remaining after electrolysis is then further enriched in a third step of enrichment in a vacuum distillator 22 to produce reactor grade deuterium oxide—99.75% pure deuterium oxide—commonly referred to as heavy water. It will be appreciated that to increase the enrichment achieved after electrolysis, initial enrichment could be as high as 1% to 5%, which is still much lower than the levels of enrichment practised in known deuterium oxide plants which use $H_2S$ separation as the initial step.

In this embodiment, as illustrated in FIG. 2, heat exchanger 7 of FIG. 1 is eliminated, the steam otherwise fed to the heat exchanger 7 now being directed to $H_2S$ enrichment unit 21 to heat water for dual temperature hydrogen sulphide exchange. The large volume of hot effluent water that results from the $H_2S$ enrichment step is available for direct underground injection 12 to effect hot water flooding of the ground deposits 1 and thereby supplement steam and hot gas injections. Of the natural water feed to the first partial enrichment operation, approximately 10% of the water would be enriched and then fed to the electrolysis units 20. The remaining 90% of the initial feed is depleted in deuterium and is hot effluent water with a temperature of approximately 120° C. at exit from the enrichment unit 21. When injected underground this hot effluent water would have a temperature between 70° C. and 90° C. after some heat loss in transport.

Reference is made to FIGS. 1 and 2. In a further embodiment of the process, if additional supplies of hydrogen are required to supplement that produced by electrolysis, either temporarily, for example because of the thermal energy requirements to emulsify the oil deposit, or as a basic supply to the upgrading units 3, the hot gases from the gasifiers may be treated in a water-gas shift reactor 23 to produce hydrogen gas for process use with a purity in the order of 97%. In this regard some of the gasifiers 4 would be equipped to produce hydrogen through such water-gas shift reactors 23 in an operation commonly known as the direct quench mode of gasifier operation.

The present invention is particularly advantageous in that it is capable, once initiated, of being essentially energy self-sufficient as a result of a high level of thermal efficiency built into the process and because all or most of the thermal energy required in the overall process—in both the recovery and upgrading stages—is produced from low value residual hydrocarbons, some part of which would otherwise become waste. It is capable of providing the required thermal energy in various forms such as hot gas, steam or hot water for underground stimulation, and steam or electric power for use in the upgrading stage of the process. In the combined energy cycle system described, electric power, steam and hot gas are produced at a rate of overall thermal efficiency of at least 40% to 45% compared to 30% to 35% in conventional energy systems where combined cycle systems are not used.

It is also particularly advantageous in that the proportion of total energy produced in process that is used in ground recovery versus the proportion used in the process units and to generate electric power for hydrogen and oxygen production by electrolysis is flexible. The process can be adapted to maximize oil deposit recovery at one end, or can be adapted to maximize the production of light oil at the other end. The thermal energy required for underground stimulation will depend on the form and location of the oil deposit, as well as on the point in time of the stimulation cycle for a given oil deposit as more thermal energy is required initially to stimulate a deposit and bring it up to operating temperature. Also, bringing new oil deposits on line for recovery would require a larger supply of thermal energy to the field. Therefore, at one extreme, where more energy is required for oil deposit recovery for any of these reasons, or simply because maximum possible recovery of a deposit is desired, the larger portion of the energy may be utilized for oil field recovery. The remainder of the energy is then used to produce sufficient electric power to produce enough hydrogen to desulphurize and hydrocrack a portion of the heavy oil mixture and thereby produce enough light oil to mix with the heavy oil mixture and render it transportable as heavy oil for further downstream refining at other plants. At the other extreme, the thermal energy can be proportioned to achieve a minimum objective for enhanced heavy oil recovery leaving sufficient energy available to achieve maximum production of light oil at the central plant. As explained above, present oil field enhanced recovery processes employ thermal stimulation in oil field recovery by burning methane or propane. They are constrained in their flexibility by the cost of providing methane or propane.

It is known that heavy oil deposits respond favourably to thermal stimulation and their recovery is thereby greatly enhanced as described above. In certain circumstances because the amount of energy required to achieve minimum recovery objectives set at any particular time and/or for any particular site, insufficient energy may be left for production of sufficient hydrogen to desulphurize all of the separated light oil fractions. In such a case, a proportion of the recovered heavy oil-water mixture may be stored temporarily or the residual feedstock to the gasifiers 4 may be supplemented with a small part of the recovered heavy oil-water mixture which would otherwise be processed to light oil. This latter procedure can be followed as long as the net cost of production of light oil (and heavy water where produced) are competitive with other heavy oil recovery and processing systems and the quantity of light oil produced meets acceptable criteria for a net yield of light oil from the natural hydrocarbon resource.

Alternatively, where supplies of coal are economically available to be shipped in, or are available for surface mining near the central plant using electric power generated in process, coal in slurried form can be used to supplement the residual feedstock to the gasifier units 4. This would obviate the need for any use of part of the heavy oil-water mixture as feed to the gasifiers thereby making more heavy oil available for hydrocracking and increasing the yield of light oils. This use of coal would increase the yield of light oil in an increment comparable to what could be extracted from the coal by liquifying it in a separate process.

Hence where the energy balance of any particular plant requires that the quantity of residaul feedstock fed to the gasifier units be supplemented this can be accomplished using a small percentage of the heavy oil-water mixture or by using coal. In doing so this will not disrupt the favourable economics of the process invention as this additional thermal energy is produced at very low cost because of the high thermal efficiency of the process in comparison with the cost of otherwise purchasing electric power or fuels for use in the processing system, or methane or propane for underground stimulation of producing hydrogen.

It will be appreciated from the foregoing that the invention can take other forms consistent with utilizing the above described process steps to thereby achieve enhanced recovery and refining of less conventional hydrocarbon resources in an economical, essentially energy self-sufficient process. It is important to the process invention that the residual hydrocarbons remaining after upgrading are used to generate thermal energy which in turn is utilized to generate various forms of energy including electric power for the electrolytic separation of hydrogen and oxygen, the hydrogen being used to carry out its most valuable function of hydrotreating to achieve sulphur removal and upgrading.

To produce the thermal energy from the hydrocarbon residuals conventional boilers could be used in combination with the gasifier units 4 described above. A combination of 7 to 9 gasifier units at the unit capacity described above and one or more conventional steam boilers may be employed. As explained above, the energy balance for a given plant may require the use of a portion of the recovered heavy oil as fuel for increased hot gas production. This additional supply of fuel can be taken from the recovered heavy oil before upgrading and sulphur removal and fed to the gasifiers which are capable of handling sulphur containing fuel. Any such heavy oil to be used as supplementary gasifier fuel may be drawn before or after oil-water separation. In a further alternative, it may be drawn from a point in oil-water separation unit 2 where the heavy crude oil and water are most thoroughly mixed or emulsified and therefore more difficult to separate, as the water content of the oil-water mixture is required in any event for gasifier operation. The heavy oil-water mixture may be mixed with the hydrocarbon residuals fed to the gasifiers. It will be appreciated that the fuel supplement may also be taken from the desulphurized light oil after sulphur removal, a procedure more likely to be followed to supply fuel for boilers when used, boilers requiring a low sulphur fuel for efficient operation.

Figure 3:
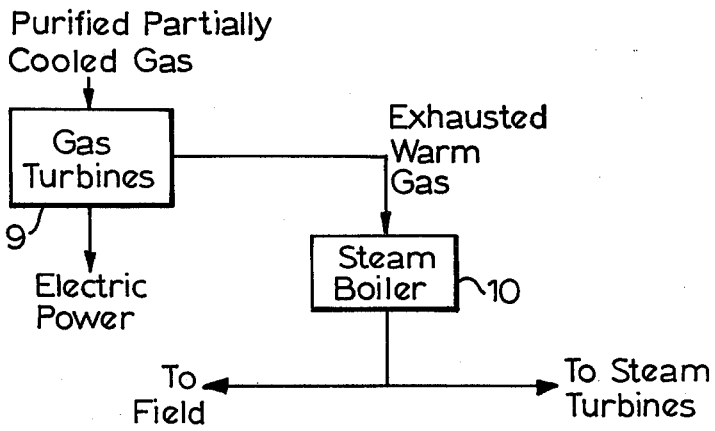
FIG. 3 is a simplified schematic flow diagram illustrating an alternative use of the gas turbines of the present invention.

Reference is now made to FIG. 3. Where underground stimulation to achieve a minimum recovery yield can be accomplished without injecting all the steam produced in steam boiler 10, a proportion of the steam can be recycled to steam turbines 6 for production of electric power. This steam transport can be accomplished over the intermediate distances between units B and A without significant heat loss. In addition, if further electric power is required, a similar recycle can be effected. Such a recycle can be carried out because of the combined energy cycles incorporated in the process. This further illustrates the benefits of the high degree of integration of the system, and takes further advantage of the combination of gasification of hydrocarbons with electrolytic production of hydrogen and oxygen. When more of the steam produced in steam boiler 10 is used for electric power production not only is a greater quantity of high purity hydorgen produced but more oxygen is available for feed to the gasifier units 4. The additional oxygen combusted in the gasifier units 4 increases the BTU content of the gasifier hot gases produced, making additional thermal energy available for underground stimulation thus providing a partial offset to the degree of total energy diverted temporarily from underground stimulation. When no steam is needed for thermal stimulation underground, all the steam from steam boilers 11 may be recycled to steam turbines 6.

It will also be apparent that the exhausted hot gas from gas turbine 8 may be injected directly into the ground rather than fed to steam boiler 10.

In addition, a portion of the oxygen produced by electrolysis, instead of being used in the gasifiers 4 to increase the BTU value of the hot gases produced, may be injected directly underground for burning to increase the temperature of the oil deposit where desirable.

As an alternative to using a heat exchanger as illustrated in FIG. 1, water at ambient temperature could be injected underground and heated in the ground using steam from steam boiler 10. In doing so, more hot gasifier gases could be channelled for eventual use in gas turbines 9 and steam production in steam boilers 10. In a further alternative the heat exchanger 7 could be located with field units B and fed steam from steam boiler 10.

Other methods of upgrading and desulphurizing the recovered heavy oil mixture which utilize hydrotreating may be employed. High purity hydrogen is produced from natural water, normally abundant and available at low cost, instead of from high value oil, naphtha or gas. Also, thermal energy is produced from low value residual hydrocarbons by means of a thermally efficient combined cycle energy system. Because of these factors, the choice of an upgrading and desulphurization means will include multiple step hydrogenation, hydrocracking and the like, but as described above the selection of a specific upgrading and desulphurizing operation, i.e. the use of kilns, fluid beds, cracking units, etc., will depend on the composition of the heavy crude oil feedstock and the availability of high purity hydrogen. The selection could include one of the more advanced hydrocracking processes known in the art and which utilize the hydrogen single molecule to crack the long chain hydrocarbon molecules to more valuable shorter chain products.

Figure 4:
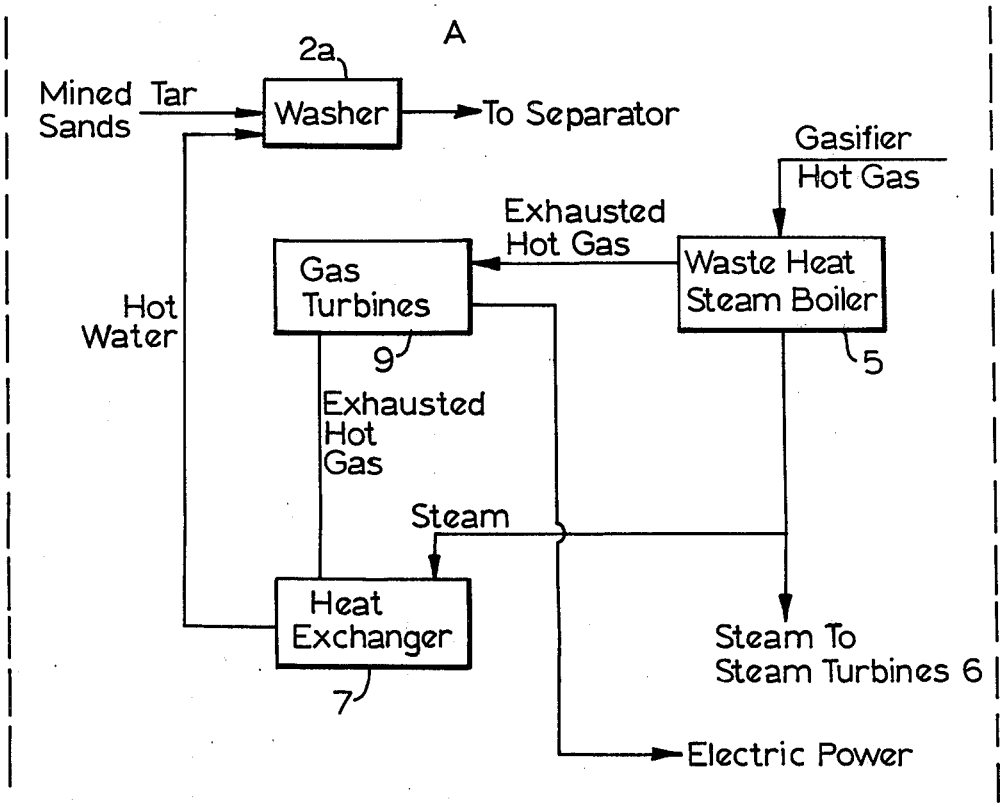
FIG. 4 is a simplified schematic flow diagram illustrating the use of the process shown in FIG. 1 for the recovery of oil from tar sands.

The above described process also can be utilized to recover bitumen from surface mined tar sands. In such cases, different field recovery techniques would be used. Reference is made to FIG. 4. The tar sands are surface mined as is conventionally done. The electrical energy for the surface mining is produced in-process. Because underground stimulation is not required, all the hot gasifier gases are utilized for steam and electric power production to provide the additional electric power required for surface mining. The mined tar sands are washed with hot water derived from the heat exchangers 7. Exhausted hot gas from gas turbines 10 is utilized as the heat transferring medium in heat exchanger 7 and is supplemented by steam from the waste heat steam boilers 5 as required. Alternatively, the hot gas from the gas turbines 10 can be mixed with steam for process use, with other steam used in heat exchanger 7 as the heat transferring medium. When heavy water is produced the waste effluent hot water resulting from dual temperature $H_2S$ exchanger 21 is used as the primary source of hot water to wash the tar sands, and is supplemented if required from a heat exchanger 7. The bitumen-water mixture thereby produced is fed to the separator 2 for water removal. The remainder of the process is essentially as described above for heavy oil application. The selection of processes for upgrading of the bitumen recovered, will, as in the case of a heavy oil application of the process, be strongly influenced by the availability of large supplies of hydrogen and the opportunity thereby provided for use of the hydrogen molecule as an efficient upgrading medium. Hydrocracking, as an upgrading step for the separation of light fractions from the recovered hydrocarbons may prove to be a preferred process considering the availability of low cost hydrogen. Alternatively, fluid coking or flexicoking processes in present use may also be employed. The waste residual hydrocarbon remaining after upgrading is a high sulphur coking residual. This is fed as fuel to the gasifier units, with possible supplementation by slurried coal or a small percentage of the bitumen feedstock if required as described above to achieve an energy balance in a given plant.

The present invention is particularly advantageous in its application to surface mined tar sands in that the process consumption of residual coking materials as fuel not only produces energy from waste material at lowest possible cost, but also eliminates an ecological problem which exists at present tar sands plants where the waste coking material is being accumulated in large volume. This is because this coking material may not be efficiently used as fuel for the conventional boilers employed due to its high sulphur content. Also, where heavy water is produced a large part of the hot water required for removal of sands from bitumen would be available as a by-product of the heavy water process.

The process as described above for heavy oil application, with minor modification, can also be used for the liquefaction of coals of any type, such as anthracite, bituminites or lignites, and shales either alone or in combination with heavy oil or tar sands bitumen. Coal or shale either treated or untreated, and crushed and dried as necessary, either alone or in slurries of coal and heavy oil would constitute the hydrocarbon feedstock. As in the case of an application of the process system to heavy oil underground recovery or tar sands bitumen recovery, the specific upgrading and desulphurizing operation employed would be selected on the basis of the particular coal or coal-oil mix of feedstock and the availability of large quantities of high purity, low cost hydrogen, the latter to exploit the advantageous upgrading properties of the hydrogen molecule. The tar residuals remaining after upgrading would be fed to gasifiers. Hot gas produced in the gasifiers would be used to produce electric power and process steam in a combined cycle arrangement as described above with respect to heavy oil application, the principal difference being that gas turbine operations would be centrally located with the waste heat boilers 5 of units A and hot exhaust gases from the gas turbines would be feed to the waste heat boilers 5 to produce steam for process requirements in the central plant. Most of the electric power produced from the hot gasifier gas would be used to produce high purity hydrogen and oxygen by electrolysis. As in the case of a heavy oil application or tar sands application the hydrogen would be used for upgrading by means, for example, of hydrocracking and the oxygen used in the gasifiers. Heavy water may also be produced, in the manner described in the above-described application of the process to heavy oil recovery, with the hot water effluent from the initial partial enrichment step being used for process steam after being stripped of $H_2S$.

In summary it will be seen from the description of the process system that it may be applied with minor variations in the process arrangement to the recovery and upgrading of various hydrocarbons, many of which are not readily amenable to recovery or upgrading, such as heavy oil, tar sands bitumen, shale or lignite and other coals. Commercial products produced by the system will be light, medium or heavy oil and elemental sulphur, and if desirable heavy water. In some circumstances surplus hot gas (synthesis gas) and electric power may also be available for commercial sale.

What I claim as my invention is:

1. A process for the recovery and upgrading of oil containing deposits such as heavy oil, tar sands, shale and coal, which once initiated is essentially energy sufficient, said process comprising the steps of:

(a) recovering the deposit;

(b) treating the deposit to obtain a feedstock;

(c) desulphurizing the feedstock with hydrogen and recovering therefrom a light oil, elemental sulphur and a heavy residual oil;

(d) electrolyzing water to produce hydrogen and oxygen, said hydrogen being utilized in step (c);

(e) gasifying said heavy residual oil in a series of gasifiers using air-oxygen mixtures to produce hot gases, wherein the concentration of air and oxygen may vary from gasifier to gasifier, the oxygen being supplied from step (d); and (f) utilizing said gasifier hot gases to provide energy for use in the process.

2. The process of claim 1 for the recovery and upgrading of tar sands deposits, wherein step (b) comprises:

washing the tar sands recovered with hot water to produce a bitumen-water mixture; and separating the water from said bitumen-water mixture to produce a bitumen feedstock for step (c).

3. The process of claim 2 wherein:

(i) step (f) comprises:

utilizing the heat of said hot gasifier gases to produce steam in boilers, and recovering lower temperature hot gases from said boilers;

utilizing the steam produced in said boilers in steps (c) and (e), and to produce electric power for use in step (c); and (ii) said process comprises the further step (g) of purifying the lower temperature hot gases recovered from the boilers of step (f) to remove impurities including sulphur and carbon and recovering elemental sulphur;

utilizing the purified hot gas to produce electric power in gas turbines and recovering residual hot gas from said gas turbines;

utilizing the heat of a member of the group of residual hot gas recovered from the gas turbines and the steam produced in the boilers in step (f) and mixtures thereof to heat water for use in said washing of the tar sands in step (b).

4. The process for the recovery and upgrading of heavy oil deposits, comprising the steps of:

(a) recovering the deposit by thermally stimulating the heavy oil deposit by injecting the deposit with a member of the group of steam, hot gases, hot water and mixtures thereof thereby creating a hot water-heavy oil emulsion, and by lifting the emulsion to the surface;

(b) treating the emulsion to separate the water therefrom and produce a heavy oil feedstock;

(c) desulphurizing the feedstock with hydrogen and recovering therefrom a light oil, elemental sulphur and a heavy residual oil;

(d) electrolizing water to produce hydrogen and oxygen, said hydrogen being utilized in step (c);

(e) gasifying said heavy residual oil in a series of gasifiers using air-oxygen mixtures to produce hot gases, wherein the concentration of air and oxygen may vary from gasifier to gasifier, the oxygen being supplied from step (d);

(f) utilizing the gasifier hot gases for injection into said heavy oil deposit, and in the preparation of hot water and steam for use in step (a) and electric power for use in step (d).

5. The process of claim 4 wherein the water to be used in step (d) is enriched in deuterium oxide to a first level of enrichment prior to being electrolyzed, the electrolysis of said water in step (d) thereby producing hydrogen, oxygen and water enriched in deuterium oxide to a second level of enrichment, said hydrogen being utilized in step (c).

6. A process as claimed in claim 5 wherein:

(i) the first level of deuterium oxide enrichment of the water to be utilized in step (d) is achieved utilizing dual temperature $H_2S$ exchange, thereby producing a stream of deuterium oxide enriched cold water and a stream of deuterium oxide depleted hot effluent water, and (ii) the stream of hot effluent water is utilized in step (a), and (iii) step (f) comprises:

dividing said gasifier hot gases into a first and second stream of gasifier hot gases;

utilizing the first stream of said gasifier hot gases in step (a);

utilizing the heat of the second stream of said gasifier hot gases in boilers to produce steam and recovering lower temperature hot gas from said boilers;

utilizing the steam produced in said boilers in steps (c) and (e), to heat water for use in dual temperature $H_2S$ exchange and to produce electric power for use in step (d); and (iv) said process comprises the further step (g) of purifying the lower temperature hot gases from said boilers to remove impurities including sulphur and carbon and recovering elemental sulphur;

utilizing the purified hot gas in step (a) for ignition for fire-flooding and to produce electric power in gas turbines and recovering residual hot gas from said gas turbines;

utilizing the residual hot gas recovered from the gas turbines to produce steam in boilers; and utilizing the steam in step (a).

7. The process as claimed in claim 5 or 6 wherein said second level deuterium oxide enriched water recovered in step (d) is further enriched to a third level of enrichment by vacuum distillation.

8. A process as claimed in claim 4 wherein:

(i) step (f) comprises:

dividing said gasifier hot gases into a first and second stream of gasifier hot gases;

utilizing the first stream of said gasifier hot gases in step (a);

utilizing the heat of the second stream of said gasifier hot gases to produce steam in boilers and recovering lower temperature hot gases from said boilers;

utilizing the steam produced in said boilers in steps (c) and (e), to produce electric power for use in step (d) and to heat water for use in step (a); and (ii) said process comprising the further step (g) of purifying the lower temperature hot gases to remove impurities including sulphur and carbon, and recovering elemental sulphur;

utilizing the purified hot gas in step (a) for ignition for fire-flooding and to produce electric power in gas turbines, and recovering residual hot gas from said gas turbines;

utilizing the residual hot gas recovered from the gas turbines to produce steam in boilers; and utilizing the steam in step (a).

9. A process as claimed in claim 8 wherein the steam produced by boilers in step (f) is utilized in steps (c) and (e) and to produce electric power for use in step (d), and wherein the steam produced by boilers in step (g) is utilized to heat water for use in step (a).

10. The process of claims 8 or 6 wherein step (c) comprises:

distilling said feedstock by distillation to produce a light oil fraction and a heavy residual oil;

hydrotreating said light oil fraction with hydrogen produced by step (d) to remove substantially all of the sulphur content of said light oil fraction and recovering a low sulphur light oil and elemental sulphur.

11. The process of claim 8 or 6 wherein:

(i) step (c) comprises:

distilling said feedstock by distillation to produce a light oil fraction and a heavy residual oil:

hydrotreating said light oil fraction with hydrogen produced by step (d) to remove substantially all of the sulphur content of said light oil fraction and recovering a low sulphur light oil and elemental sulphur; and dividing the heavy residual oil produced by said distillation into two parts;

hydrocracking a first part of said heavy residual oil with hydrogen produced by step (d) and recovering second quantities of light oil fractions and heavy residual oil;

hydrotreating said second quantity of light oil with hydrogen produced by step (d) and recovering second quantities of low sulphur light oil and elemental sulphur; and (ii) step (f) comprises:

gasifying a second part of said heavy residual oil and said second quantity of heavy residual oil in a series of gasifiers using air-oxygen mixtures to produce hot gases, wherein the concentration of air and oxygen may vary from gasifier to gasifier, the oxygen being supplied from step (d).

12. The process of claim 8 or 6 wherein in step (a) a first part of said first stream of gasifier hot gases is injected directly into said heavy oil deposits and a second part of said first stream of gasifier hot gases is injected into said heavy oil deposits together with the steam utilized in step (a).

13. The process of claim 8 or 6 wherein the residual hot gas from said gas turbines in step (g) is recycled to step (f) as feed to said boilers.

14. The process of claim 8 or 6 wherein the residual hot gas from said gas turbines in step (g) is utilized in step (a) for ignition for fire flooding.

15. The process of claim 8 or 6 wherein a portion of the steam produced in the boilers in step (g) is recycled to step (f) for the production of electric power.

16. The process of claim 8 or 6 wherein said gasifier hot gases are divided into a third stream of gasifier hot gases and said process comprises the further step (h) of:

passing said third stream of gasifier hot gases through a water-gas shift reactor to produce a stream of hydrogen gas for use in said step (c).

17. The process of claim 4 or 5 wherein the heavy residual oil recovered in step (c) and to be gasified in step (e) is supplemented by a portion of the heavy oil feedstock.

18. The process of claim 4 or 5 wherein the heavy residual oil recovered in step (c) and to be gasified in step (e) is supplemented by one of coal and coke.

* * * * *